US009705247B2

(12) United States Patent
Sekino et al.

(10) Patent No.: US 9,705,247 B2
(45) Date of Patent: Jul. 11, 2017

(54) CONNECTOR

(71) Applicant: YAZAKI CORPORATION, Tokyo (JP)

(72) Inventors: Tetsuya Sekino, Shizuoka (JP); Toshinori Yamamoto, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/244,072

(22) Filed: Aug. 23, 2016

(65) Prior Publication Data

US 2016/0359263 A1 Dec. 8, 2016

Related U.S. Application Data

(63) Continuation of application No. PCT/JP2015/058269, filed on Mar. 19, 2015.

(30) Foreign Application Priority Data

Mar. 26, 2014 (JP) ..... 2014-063752

(51) Int. Cl.
*H01R 13/627* (2006.01)
*H01R 13/639* (2006.01)

(52) U.S. Cl.
CPC ..... *H01R 13/6272* (2013.01); *H01R 13/6273* (2013.01); *H01R 13/639* (2013.01)

(58) Field of Classification Search
CPC ..... H01R 13/639; H01R 13/4368; H01R 13/6272; H01R 13/641; H01R 2201/26; H01R 12/716; H01R 13/20; H01R 13/62938; H01R 12/7005; H01R 12/707; H01R 12/73; H01R 12/79; H01R 13/2435; H01R 13/4223
See application file for complete search history.

(56) References Cited

U.S. PATENT DOCUMENTS 6,692,274 B2 * 2/2004 Maegawa ..... H01R 13/62933 439/157
7,549,887 B1 * 6/2009 Ng ..... H01R 13/6272 439/352

(Continued)

FOREIGN PATENT DOCUMENTS

JP 2002-151202 A 5/2002
JP 2002-184523 A 6/2002

(Continued)

*Primary Examiner* — Truc Nguyen
(74) *Attorney, Agent, or Firm* — Mots Law, PLLC

(57) ABSTRACT

This connector is provided with: a first connector which is fixed to connector mounting parts, and which is provided with a first housing for holding a first terminal; and a second connector part which is provided with an inner housing for holding a second terminal, and a sheath housing having the inner housing accommodated therein. When the second connector part is moved towards the first connector part in a connector fitting direction, a first lock part and a second lock part engage with each other at a fitted position between the first housing and the inner housing and the sheath housing have, provided thereto, pressing unit which, when in the sheath fitted position, impel the inner housing in a direction in which the inner housing is fitted to the first housing.

4 Claims, 17 Drawing Sheets

(56) References Cited

U.S. PATENT DOCUMENTS 7,591,665 B2 * 9/2009 Nakamura ..... H01R 13/641 439/374
7,789,690 B1 * 9/2010 Rhein ..... H01R 13/53 439/310
8,109,789 B2 * 2/2012 Tyler ..... H01R 13/5205 439/587
2006/0009058 A1 1/2006 Nagano
2006/0068634 A1 * 3/2006 Petersen ..... H01R 13/745 439/578
2007/0093120 A1 * 4/2007 Hardy ..... H01R 13/506 439/468
2008/0048479 A1 2/2008 Yoshida
2009/0104805 A1 * 4/2009 Daudin ..... H01R 13/4365 439/274
2010/0055961 A1 * 3/2010 Martin ..... H01R 13/4365 439/345
2010/0255709 A1 * 10/2010 Tyler ..... H01R 13/53 439/367
2011/0143566 A1 * 6/2011 Nakamura ..... H01R 13/533 439/271
2012/0149229 A1 * 6/2012 Kearsley ..... A61M 1/127 439/339
2012/0184125 A1 * 7/2012 Suzuki ..... H01R 13/193 439/345
2012/0214325 A1 * 8/2012 Zhu ..... H01R 13/6273 439/312

FOREIGN PATENT DOCUMENTS

JP 2002-190358 A 7/2002
JP 2006-024456 A 1/2006
JP 2008-052975 A 3/2008

* cited by examiner

CONNECTOR

CROSS REFERENCE TO RELATED APPLICATIONS

This application is a Continuation of PCT Application No. PCT/JP2015/058269, filed on Mar. 19, 2015, and claims the priority of Japanese Patent Application No. 2014-063752, filed on Mar. 26, 2014, the content of both of which is incorporated herein by reference.

BACKGROUND

Technical Field

The present invention relates to a connector in which one connector part of a housing is formed of two members.

Related Art

Examples of this kind of connectors of the past include a connector disclosed in JP 2008-52975 A. A connector 100 includes, as illustrated in FIGS. 16A to 17B, a first connector part 101 arranged in a stay member 130 and a second connector part 110 arranged in an accommodating member 131.

The first connector part 101 includes a first terminal 102 and a first housing 103 for holding the first terminal 102. The first housing 103 includes a first lock part 104 formed on the outer periphery. The first lock part 104 has a groove 106 formed at an intermediate part of the first lock part 104.

The second connector part 110 includes a second terminal 111, an inner housing 112 for holding the second terminal 111, and a sheath housing 113 arranged on the outer periphery of the inner housing 112 in a movable manner relative to the inner housing 112. The inner housing 112 includes an elastically deformable lock arm 114. The lock arm 114 has a locking part 114*a* at a tip end of the lock arm 114. The locking part 114*a* is outwardly deformable by the elastic deformation of the lock arm 114. The sheath housing 113 includes a sheath lock part 115. The sheath lock part 115 is formed to be outwardly deformable by the elastic deformation.

When the first connector part 101 is moved in a connector fitting direction, as illustrated in FIG. 16A, the tip end of the first lock part 104 comes to interfere with the locking part 114*a* of the lock arm 114 in the inner housing 112. When the first connector part 101 is further moved in the connector fitting direction I from this position, as illustrated in FIG. 16B, the lock arm 114 and the sheath lock part 115 outwardly deform by the elastic deformation, allowing the first connector part 101 to be moved in the connector fitting direction I. When the locking part 114*a* of the lock arm 114 reaches the position of the groove 106 of the first lock part 104, as illustrated in FIG. 17A, the locking part 114*a* of the lock arm 114 enters the groove 106 due to elastic returning deformation. Thus, the first housing 103 and the inner housing 112 come to a fitting completed position at which the first terminal 102 and the second terminal 111 are in contact with each other appropriately.

The locking part 114*a* of the lock arm 114 enters the groove 106 to release the locked condition between the locking part 114*a* of the lock arm 114 and the sheath lock part 115, allowing the sheath housing 113 to move relative to the inner housing 112. When the first connector part 101 is moved from this position in the connector fitting direction I, the inner housing 112 moves with the first housing 103 to cause the locking part 114*a* of the lock arm 114 to climb over the sheath lock part 115. The first housing 103 and the inner housing 112 continue to move, as illustrated in FIG. 17B, and the sheath lock part 115 enters a locking groove 107 of the stay member 130 to bring the sheath housing 113 to a sheath fitted position. The connector fitting movement is thus completed.

At the sheath fitted position of the sheath housing 113 of the past example described above, the sheath housing 113 prevents the elastic deformation of the lock arm 114. This securely prevents unlocking between the first lock part 104 of the first connector part 101 and the lock arm 114 of the second connector part 110.

In addition, the connector can have an excellent anti-vibration characteristic if the first connector part 101 is fixed on a connector mounting part, because the housing of the second connector part 110 is formed of two members including the inner housing 112 and the separately formed sheath housing 113. Specifically, the second connector part side fitted in the first connector part 101 has a smaller mass compared to the case in which the housing of the second connector part 110 is formed of one member. As a result, the vibration caused by external vibration can be suppressed.

SUMMARY OF THE INVENTION

In the connector 100 of the past example described above, however, the first housing 103 and the inner housing 112 are engaged with each other only by engagement of the first lock part 104 with the lock arm 114. Accordingly, the fitting force between the first housing 103 holding the first terminal 102 and the inner housing 112 holding the second terminal 111 is weak and cannot effectively suppress the vibration of the inner housing 112 caused by the vibration of the first housing 103. Separate and independent vibrations of the first housing 103 and the inner housing 112 cause sliding between the first terminal 102 and the second terminal 111 and decrease contact reliability. The contact reliability between terminals is important particularly when the connector 100 is mounted at a position susceptible to vibrations.

The present invention has been devised to solve the above problem, and an object of the present invention is to provide a connector capable of improving the anti-vibration characteristic and improving the contact reliability between terminals.

A first aspect according to the present invention is a connector having a first connector part fixed on a connector mounting part and including a first housing for holding a first terminal, and a second connector part including an inner housing for holding a second terminal and a sheath housing accommodating the inner housing and movable to the inner housing. The first housing is provided with a first lock part. The inner housing is provided with a second lock part capable of locking with the first lock part. The sheath housing is provided with a sheath lock part that prevents movement relative to the inner housing until the second lock part locks with the first lock part, and allows the movement with the inner housing when the second lock part is locked with the first lock part. The first lock part is locked with the second lock part at a fitting completed position between the first housing and the inner housing when the second connector part is moved relative to the first connector part in a connector fitting direction, and the sheath housing is subsequently moved to a sheath fitted position relative to the inner housing. The inner housing and the sheath housing include pressing unit that urges the inner housing in a fitting direction with the first housing at the sheath fitted position.

A second aspect according to the present invention relates to the first aspect, the sheath lock part may be formed to be elastically deformable in a direction to climb over the first lock part and the second lock part. The first lock part may be formed to allow the sheath lock part to climb over the first lock part. The second lock part may be fanned to prevent the sheath lock part from climbing over the second lock part before the second lock part locks with the first lock part, and may be formed to allow the sheath lock part to climb over the second lock part when the second lock part is locked with the first lock part. The sheath lock part is not able to climb over the second lock part until the second lock part locks with the first lock part in a connector fitting step, such that a movement relative to the inner housing is prevented, and the sheath lock part climbs over the first lock part and the second lock part to allow the sheath housing to move relative to the inner housing when the second lock part is locked with the first lock part.

A third aspect according to the present invention relates to the first aspect or the second aspect, the pressing unit may be a pressing part including a tapered part provided on the inner housing and inclined relative to the connector fitting direction, and a pressing part provided on the sheath housing to press the tapered part at the sheath fitted position.

A fourth aspect according to the present invention relates to the first aspect, second aspect, or the third aspect, the first housing may include a plurality of backlash reduction ribs formed on a side wall of a housing fitting chamber of the first housing to press a side surface of the inner housing.

According to the aspects of the present invention, the fitting force between the first housing and the inner housing increases by the pressing unit. The first housing and the inner housing thus unitarily vibrate to prevent sliding between the first terminal and the second terminal due to the separate and independent vibrations of the housings, and contact reliability between the terminals improves.

DETAILED DESCRIPTION

An embodiment of the present invention will be described below by referring to the accompanying drawings.

Figure 9:
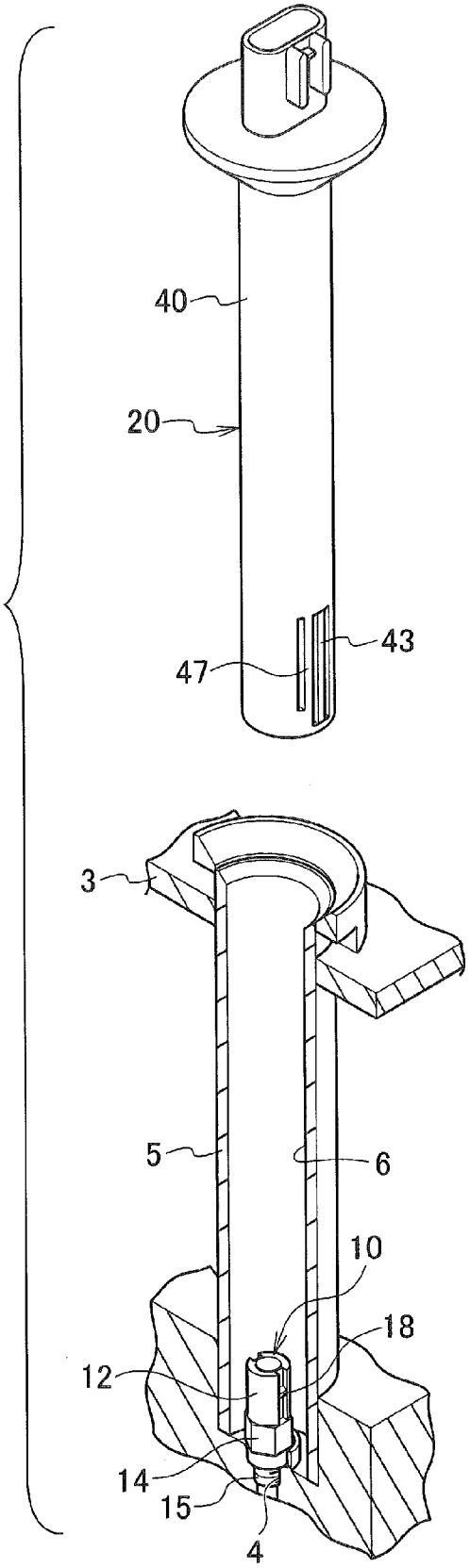
FIG. 9 is a perspective view of a second connector part before being fitted into a first connector part according to the embodiment of the present invention.
Figure 10:
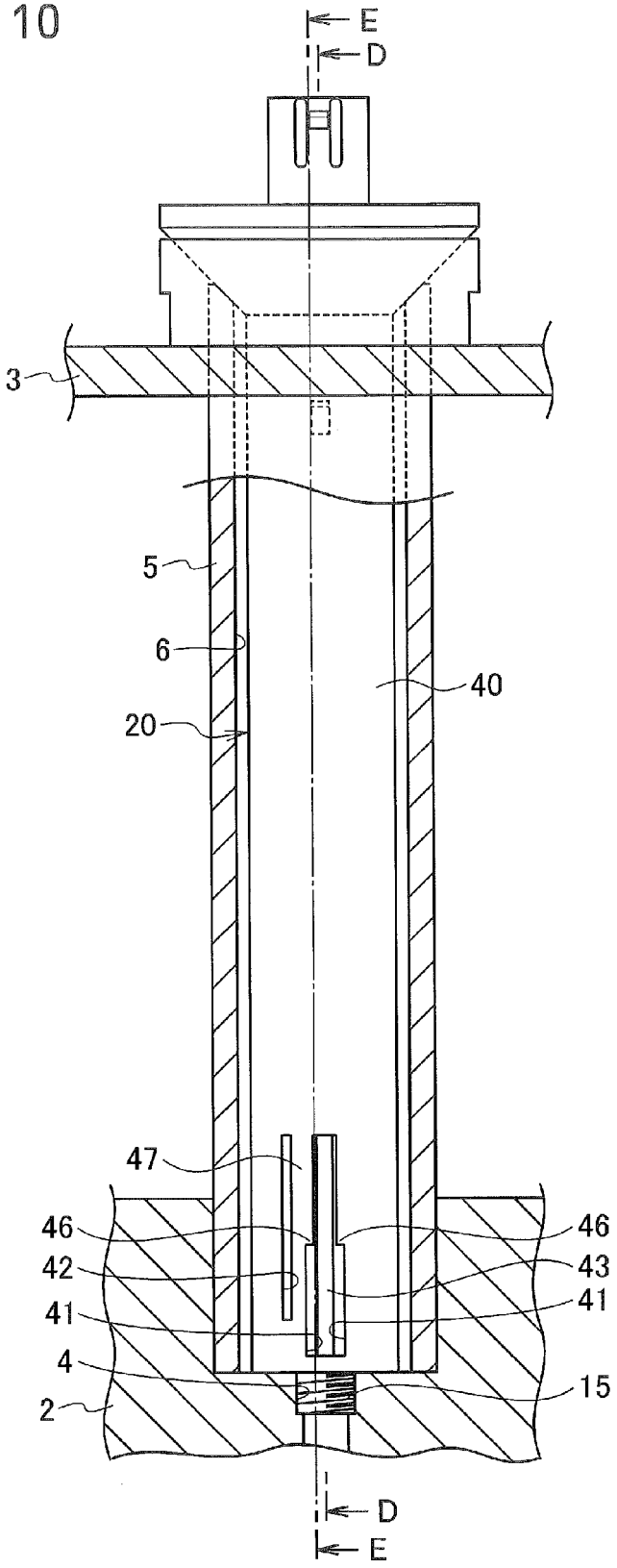
FIG. 10 is a cross-sectional view of the second connector part after being fitted into the first connector part according to the embodiment of the present invention.

FIGS. 1 to 15 illustrate an embodiment of the present invention. First, a connector mounting part for mounting a connector 1 is described. The connector mounting part includes a cylinder head 2 and a cylinder head cover 3 arranged to cover the outer surface of the cylinder head 2, as illustrated in FIGS. 9 and 10. The cylinder head 2 has a connector mounting hole 4. The connector mounting hole 4 has female threads formed on the inner periphery thereof. A male connector part 10, which is a first connector part, is fixed to the connector mounting hole 4. The cylinder head cover 3 includes a tubular part 5 formed at a position above each connector mounting hole 4. Interior of each tubular part 5 is regarded as a connector insertion hole 6. A female connector part 20, which is a second connector part, is inserted into the connector insertion hole 6, and the inserted female connector part 20 is mounted on the male connector part 10.

Figure 1:
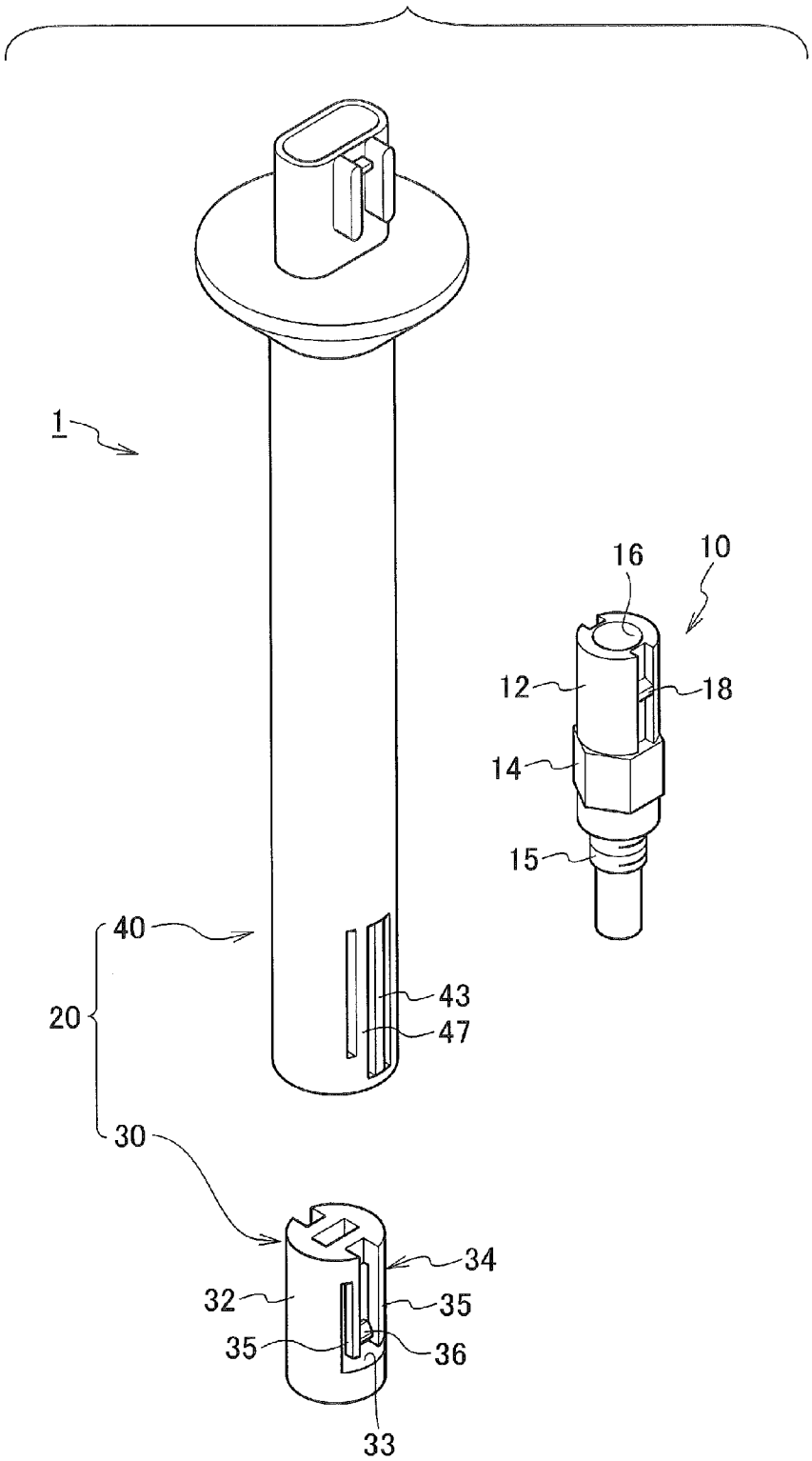
FIG. 1 is an exploded perspective view of a connector according to an embodiment of the present invention.
Figure 2A:
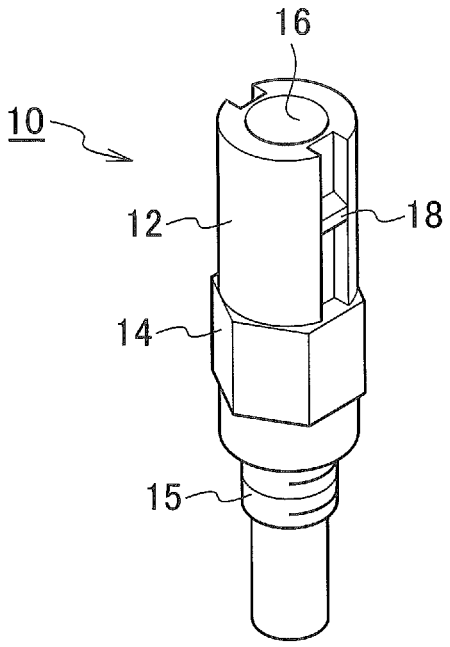
FIG. 2A illustrates a perspective view of a male connector part according to the embodiment of the present invention.
Figure 2B:
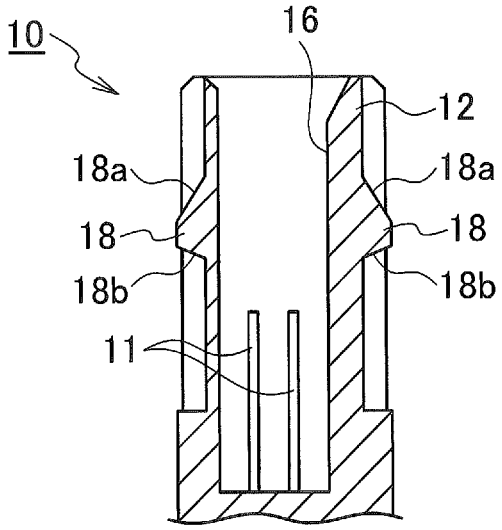
FIG. 2B illustrates a cross-sectional view of main components of the male connector part according to the embodiment of the present invention.
Figure 3A:
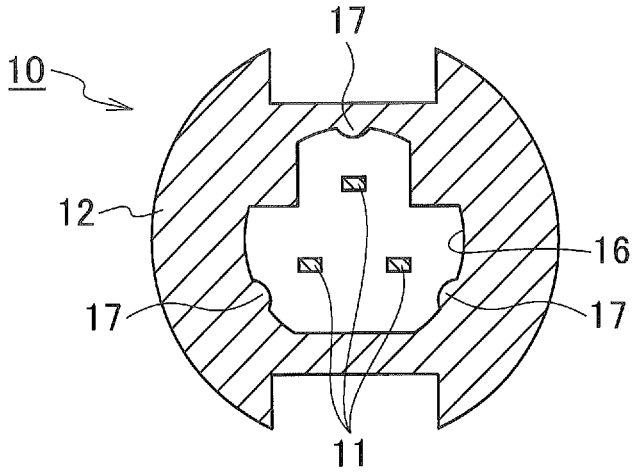
FIG. 3A illustrates a cross-sectional view of the male connector part according to the embodiment of the present invention.
Figure 3B:
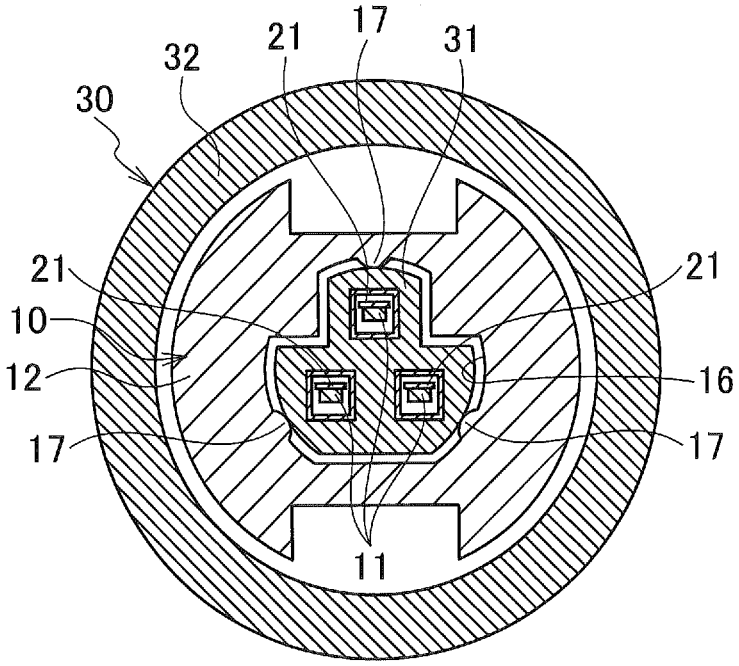
FIG. 3B illustrates a cross-sectional view of the male connector part according to the embodiment of the present invention with an inner housing fitted thereto.

As illustrated in FIG. 1, the connector 1 includes the male connector part 10 provided as the first connector part and the female connector part 20 provided as the second connector part. The male connector part 10 includes a plurality of male terminals 11 provided as first terminals, and a first housing 12 for holding the male terminals 11, as illustrated in FIGS. 1, 2A, 2B, 3A and 3B. The first housing 12 has a fixing nut part 14 and a male screw part 15 at the lower part of the first housing 12. The male connector part 10 is fixed to the cylinder head 2 by screwing the male screw part 15 into the connector mounting hole 4 of the cylinder head 2. In other words, the male connector part 10 is fixed at an inner position of the connector insertion hole 6 of the cylinder head cover 3.

Figure 7:
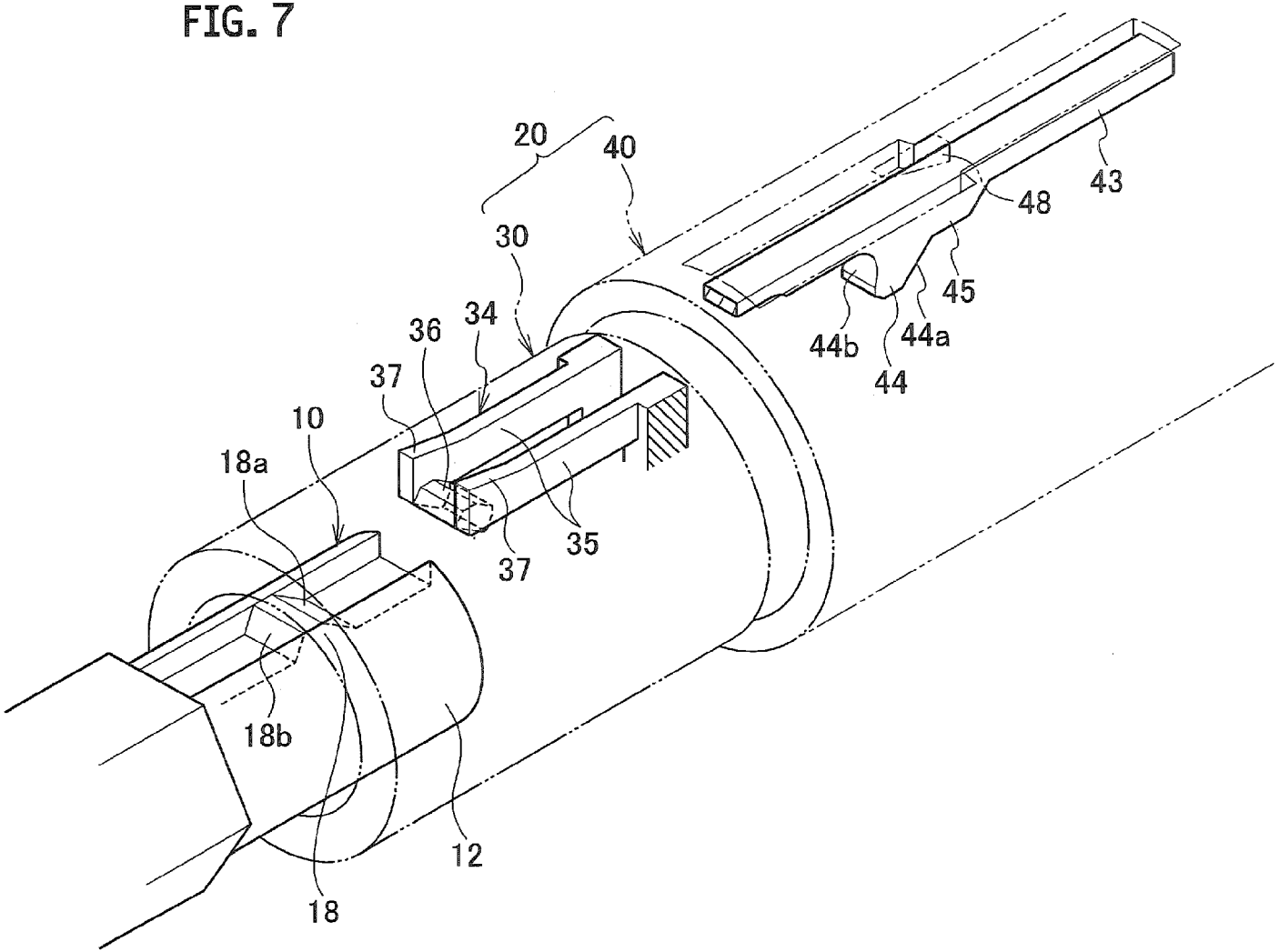
FIG. 7 is a perspective view schematically illustrating main components of the sheath housing, the inner housing, and the first housing according to the embodiment of the present invention.
Figure 8B:
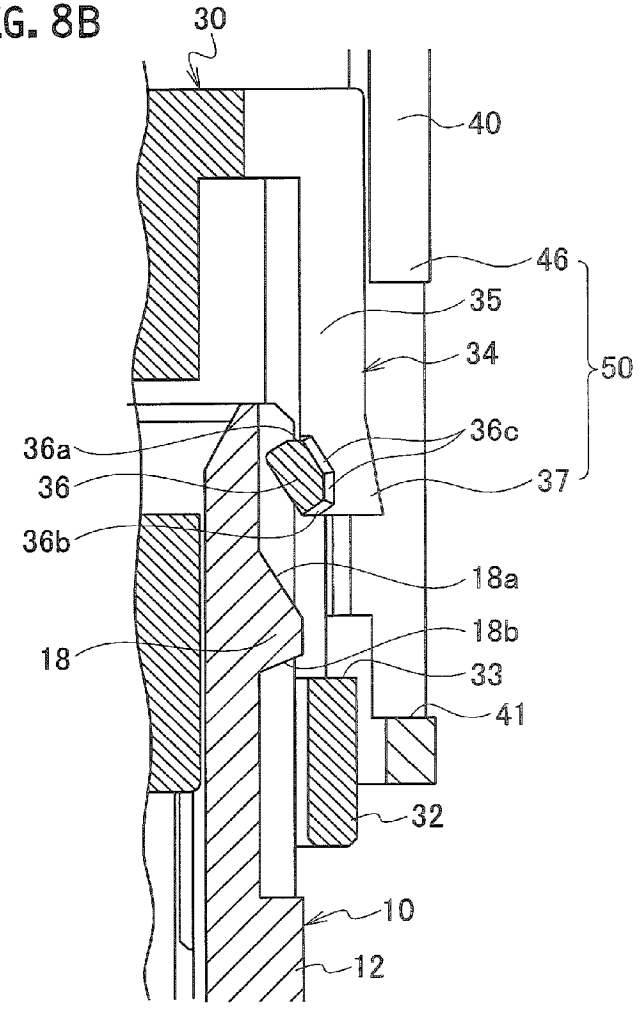
FIG. 8B illustrates a cross-sectional view of main components of the sheath housing, the inner housing, and the first housing at a position different from the position illustrated in FIG. 8A.
Figure 8A:
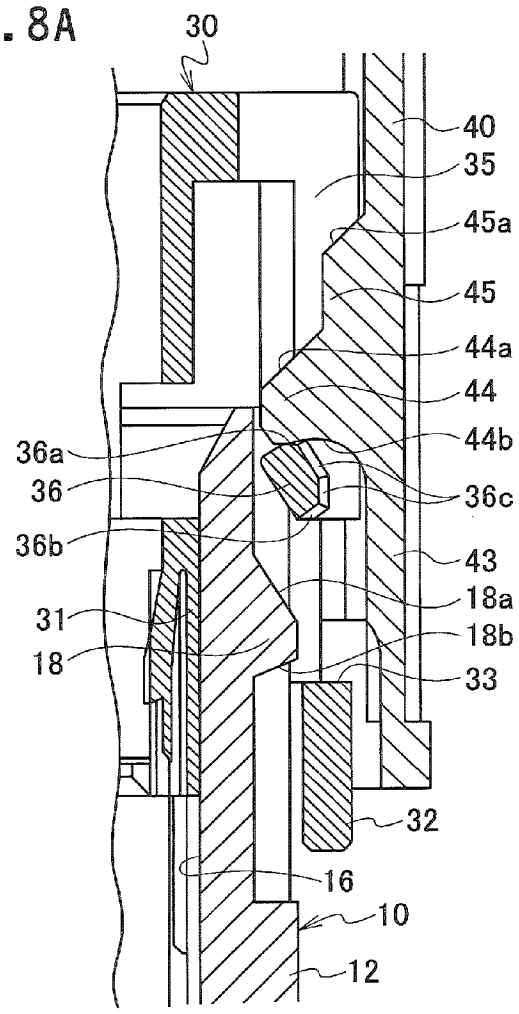
FIG. 8A illustrates a cross-sectional view of main components of the sheath housing, the inner housing, and the first housing according to the embodiment of the present invention.

The first housing 12 has a tubular upper part and a housing fitting chamber 16 formed therein, as illustrated in, for example, FIGS. 7, 8A and 8B. The male terminals 11 are arranged in the housing fitting chamber 16. The housing fitting chamber 16 has backlash reduction ribs 17 (illustrated in FIGS. 3A and 3B) at three positions of the side wall. The three backlash reduction ribs 17 are arranged at equal intervals from each other.

The first housing 12 includes first lock parts 18 formed symmetrically on the outer periphery thereof. Each of the first lock parts 18 has a projecting shape, with an upstream tapered face 18*a* and a downstream nearly vertical face, that is, a locking face 18*b* in a connector fitting direction G. The connector fitting direction G represents a direction in which the female connector part 20 is fitted into the male connector part 10.

Figure 4B:
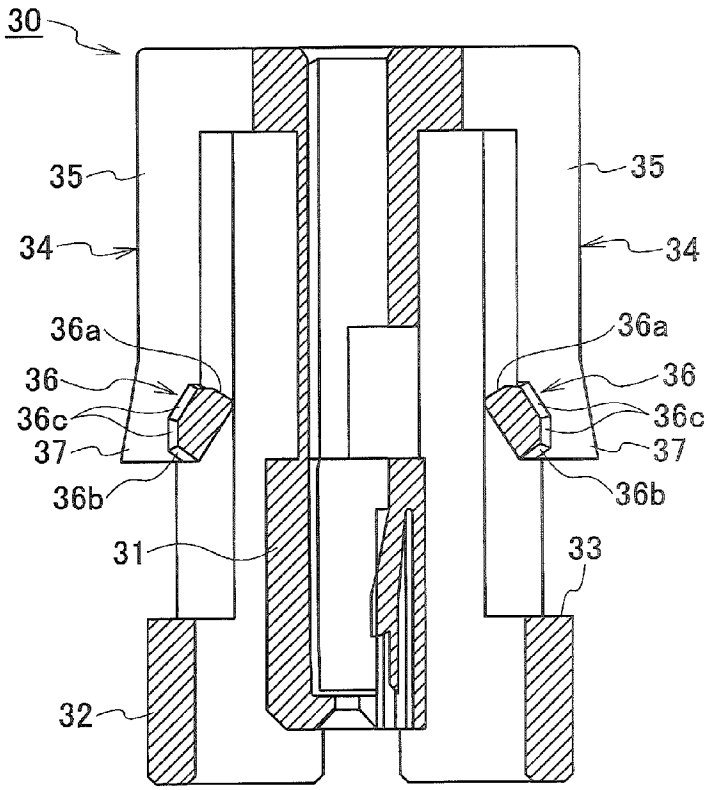
FIG. 4B illustrates a cross-sectional view cut along line A-A of FIG. 4A.
Figure 4A:
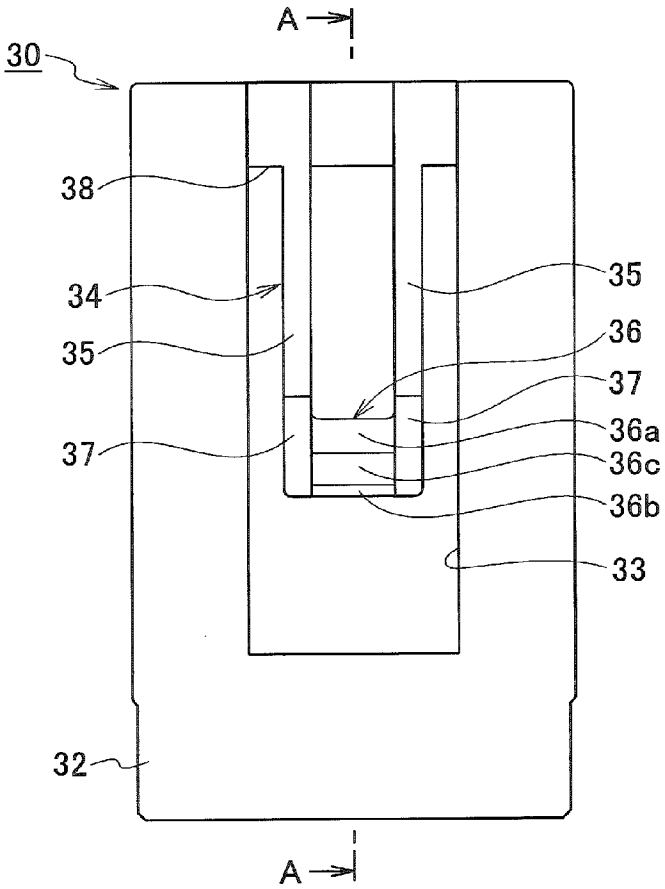
FIG. 4A illustrates a side view of the inner housing according to the embodiment of the present invention.
Figure 5A:
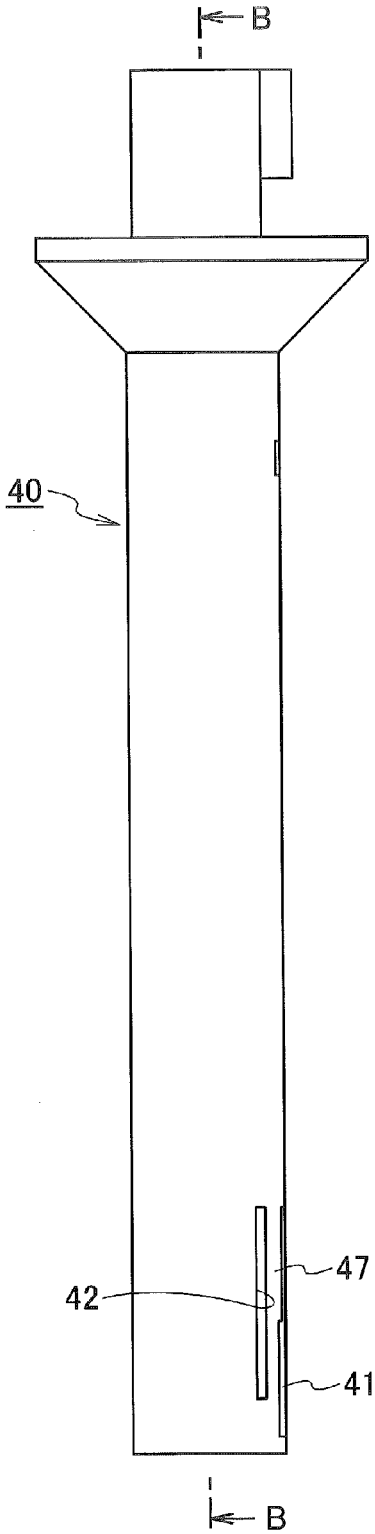
FIG. 5A illustrates a front view of a sheath housing according to the embodiment of the present invention.
Figure 5B:
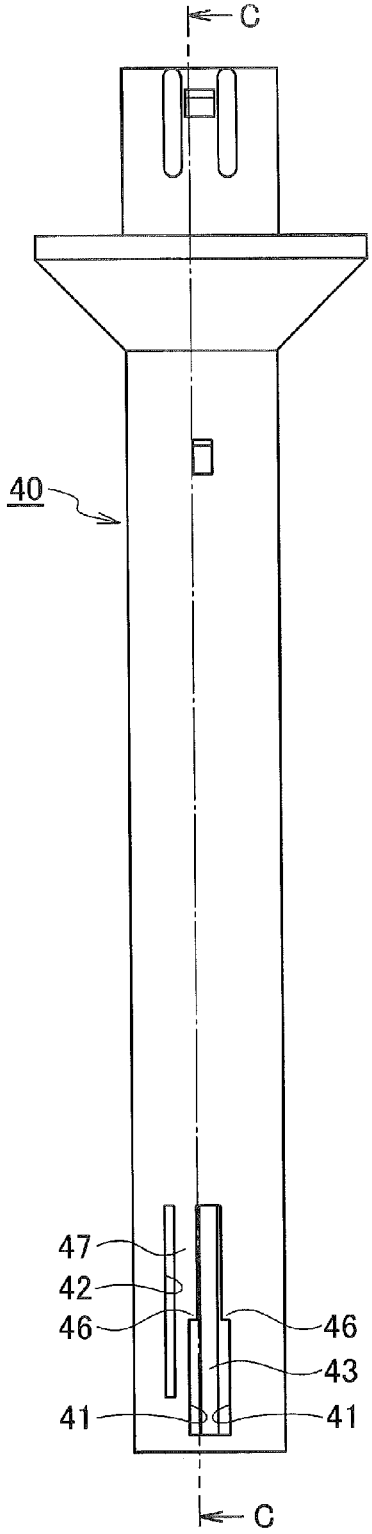
FIG. 5B illustrates a side view of the sheath housing according to the embodiment of the present invention.
Figure 6A:
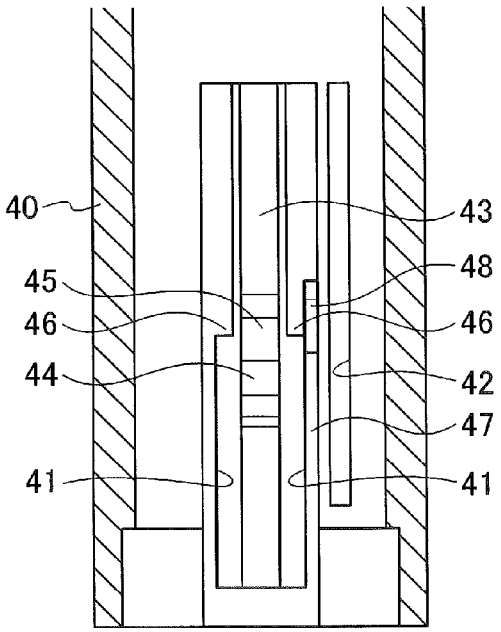
FIG. 6A illustrates a cross-sectional view of main components cut along line B-B of FIG. 5A.
Figure 6B:
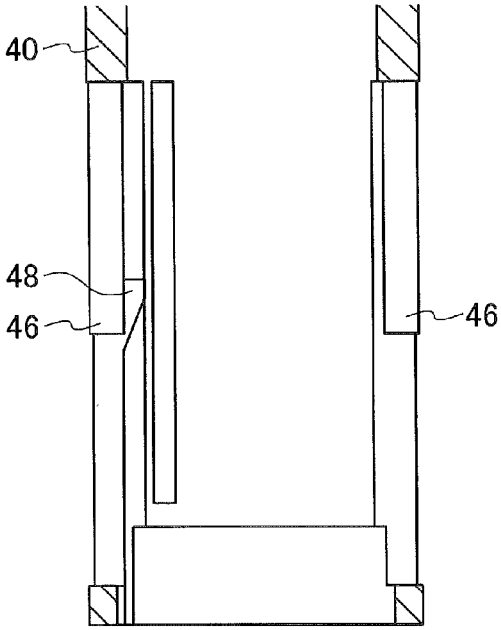
FIG. 6B illustrates a cross-sectional view of main components cut along line C-C of FIG. 5B.

The female connector part 20 includes, as illustrated in FIG. 1, an inner housing 30 for holding a plurality of female terminals 21 provided as second terminals, and a sheath housing 40 having the inner housing 30 accommodated therein. The inner housing 30 has a tubular terminal holding part 31 and an outer tubular part 32 covering the outer periphery of the tubular terminal holding part 31, as illustrated in FIGS. 4A and 4B. The tubular terminal holding part 31 is fitted in the housing fitting chamber 16 at the connector fitting completed position (see FIG. 3B).

The outer tubular part 32 has slits 33 formed symmetrically on the outer periphery thereof In the region corresponding to the slits 33, lock arms 34 are provided as second lock parts. The lock arms 34 include a pair of flexible arm parts 35, with base ends thereof supported by the outer tubular part 32, and a lock beak part 36 to which the tip ends of the pair of flexible arm parts 35 are connected. The lock beak part 36 has upstream and downstream nearly vertical faces, that is, locking faces 36*a*, 36*b*, in the connector fitting direction G, and also has an intermediate climbing face 36*c* capable of being climbed over. The flexible arm parts 35 have tapered parts 37 at tip ends thereof, the tapered parts 37 being inclined outward relative to the connector fitting direction G. The tapered parts 37 form part of pressing unit 50 as described below.

The sheath housing 40 has a retaining projection 48 descried below, which enters an outer slit region of one of the lock arms 34 of the slit 33. An upper edge of the position of the slit is formed as a stopper end face 38.

The sheath housing 40 has a cylindrical shape, as illustrated in FIG. 1 and FIGS. 5A to 8B. The sheath housing 40 includes a pair of first slits 41 extending long and narrow in a longitudinal direction and a pair of second slits 42 also extending long and narrow near the first pair of slits 41, each pair of slits being formed symmetrically in the lower part of the sheath housing 40. A first flexible arm part 43 is formed between the pair of first slits 41. The first flexible arm part 43 has a sheath lock part 44 on the inner surface thereof The sheath lock part 44 is outwardly deformable by flexible deformation of the first flexible arm part 43. The sheath lock part 44 has an upstream tapered face 44*a* and a downward nearly vertical locking face 44*b* in the connector fitting direction G (see FIGS. 8A and 8B). The first flexible arm part 43 has a releasing projecting part 45 formed above and continuously from the sheath lock part 44. The releasing projecting part 45 has a tapered face 45*a* on the side where a releasing jig 51 is inserted.

The pair of first slits 41 has an upper edge part provided as a pressing part 46. The pressing part 46 presses the tapered part 37 of the female connector part 20 at the sheath fitted position. The tapered part 37 of the female connector part 20 and the pressing part 46 of the sheath housing 40 forms the pressing unit 50 (illustrated in FIG. 8B).

A second flexible arm part 47 is formed between one of the pair of first slits 41 and one of the pair of second slits 42. The second flexible arm part 47 has a retaining projection 48 on the inner surface thereof. The retaining projection 48 is outwardly deformable by flexible deformation of the second flexible arm part 47.

Figure 11C:
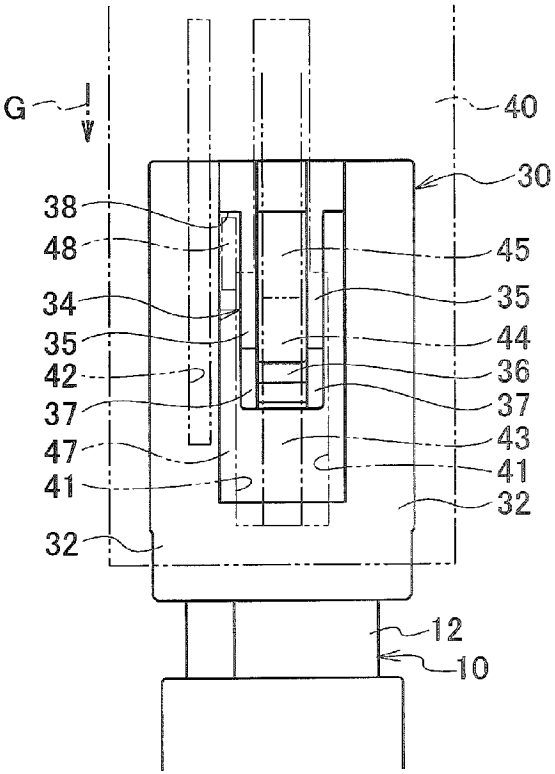
FIG. 11C illustrates an external view illustrating a position relationship between housings in the same operation step of the fitting operation illustrated in FIG. 11A.
Figure 11B:
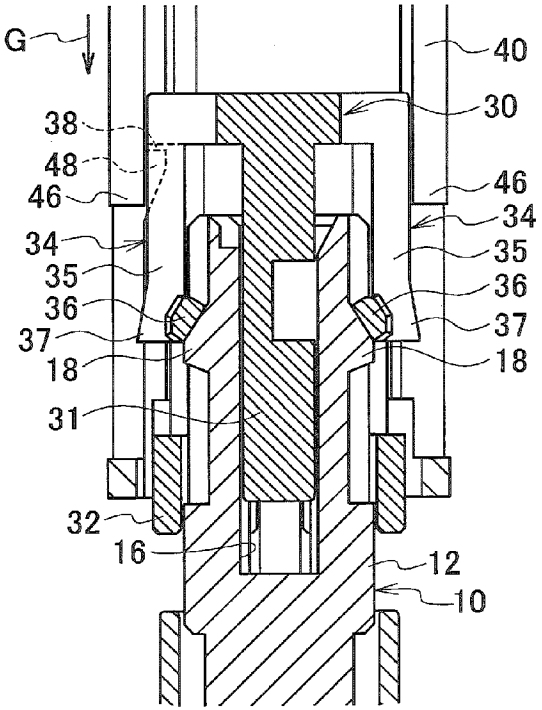
FIG. 11B illustrates a cross-sectional view cut along line E-E of FIG. 10 in the same operation step of the fitting operation illustrated in FIG. 11A.
Figure 11A:
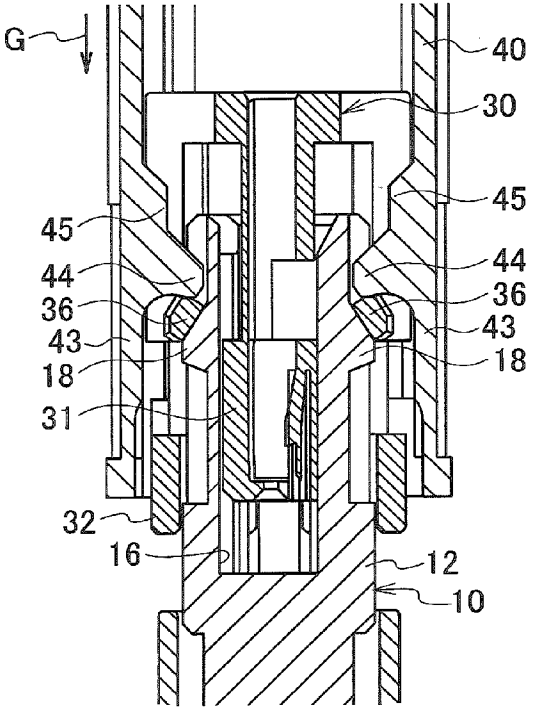
FIG. 11A illustrates a cross-sectional view cut along line D-D of FIG. 10.

Next, the female connector part 20 is assembled as described below. The inner housing 30 is inserted into the sheath housing 40 from below, as illustrated in FIG. 1. The retaining projection 48 of the sheath housing 40 comes to interfere with the upper edge of the inner housing 30 and, beyond this position, the inner housing 30 is further inserted inward. The second flexible arm part 47 of the sheath housing 40 elastically deforms outward to allow insertion of the inner housing 30, and the retaining projection 48 enters the slit 33 of the inner housing 30. The assembly of the female connector part 20 is thus completed. The retaining projection 48 of the sheath housing 40 impinges on the stopper end face 38 of the inner housing 30 to prevent movement of the inner housing 30 in a releasing (falling) direction, as illustrated in FIGS. 7, 8A, and 8B. The lock beak part 36 of the inner housing 30 impinges on the sheath lock part 44 of the sheath housing 40 to prevent further inward movement of the inner housing 30. FIGS. 11A to 11C illustrate a positional relationship of initial positions of the inner housing 30 and the sheath housing 40.

Next, the female connector part 20 is fitted into the male connector part 10 as described below. The female connector part 20 is inserted into the connector insertion hole 6 of the cylinder head cover 3 as illustrated in FIG. 9, and the inserted female connector part 20 is fitted into the male connector part 10 as illustrated in FIG. 10. This connector fitting movement is described in detail below.

Figure 12C:
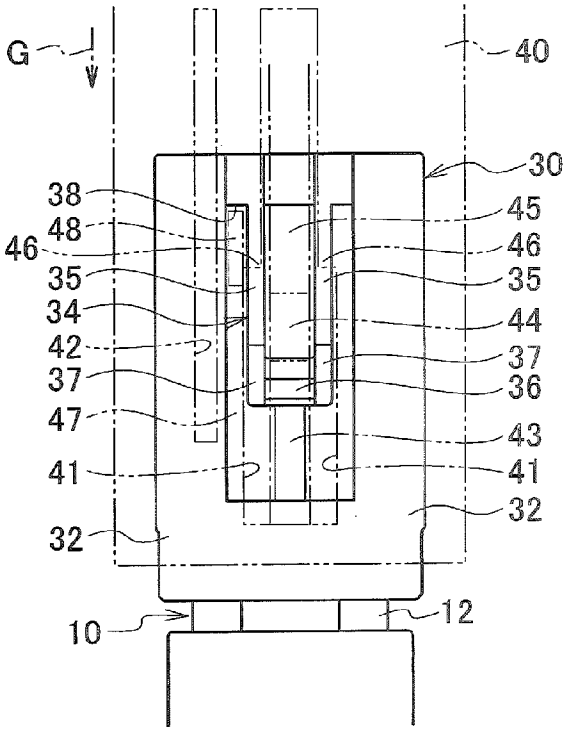
FIG. 12C illustrates an external view illustrating a position relationship between housings in the same operation step of the fitting operation illustrated in FIG. 12A.
Figure 12B:
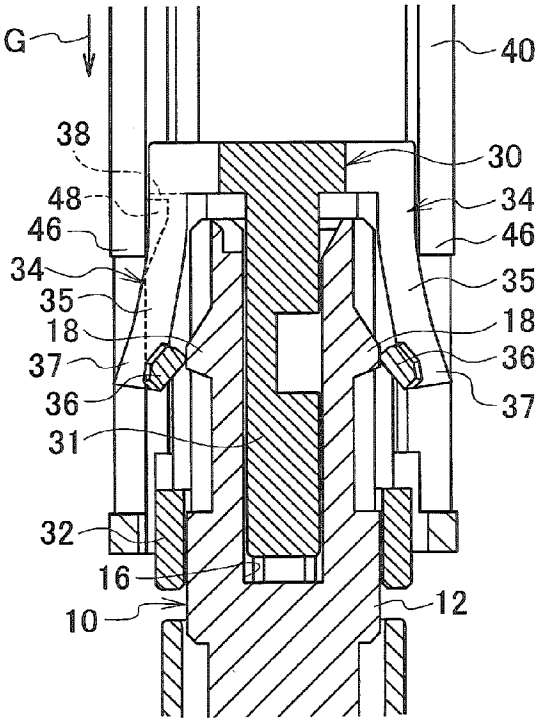
FIG. 12B illustrates a cross-sectional view cut along line E-E of FIG. 10 in the same operation step of the fitting operation illustrated in FIG. 12A.
Figure 12A:
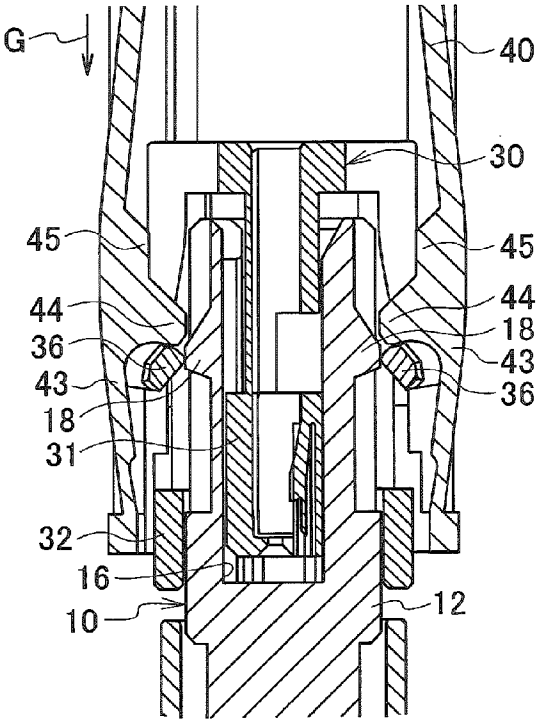
FIG. 12A illustrates a cross-sectional view cut along line D-D of FIG. 10.

First, the first lock part 18 of the male connector part 10 abuts on the lock beak part 36 of the inner housing 30 of the female connector part 20, allowing the inner housing 30 to move inward of the sheath housing 40. The lock beak part 36 then abuts on the sheath lock part 44 of the sheath housing 40, as illustrated in FIGS. 11A to 11C, preventing inward movement of the inner housing 30. The female connector part 20 is pressed in the connector fitting direction G in this state, causing outward flexible deformation of the lock arm 34 of the inner housing 30, as illustrated in FIGS. 12A to 12C. The first flexible arm part 43 of the sheath housing 40 further flexibly deforms outward to allow insertion of the female connector part 20. The lock beak part 36 and the sheath lock part 44 climb over the first lock part 18 of the male connector part 10. When the lock beak part 36 has completely climbed over the first lock part 18, the lock arm 34 then recovers from flexible deformation to lock the lock beak part 36 with the first lock part 18 of the male connector part 10. Thus, the first housing 12 and the inner housing 30 are in the fitting completed position, and the male terminals 11 and the female terminals 21 are in contact with each other appropriately.

Figure 13C:
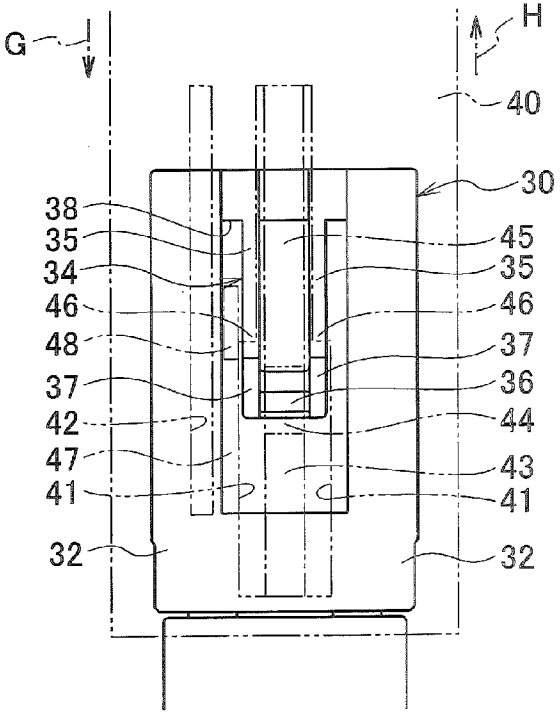
FIG. 13C illustrates an external view illustrating a position relationship between housings in the same operation step of the fitting operation illustrated in FIG. 13A.
Figure 13B:
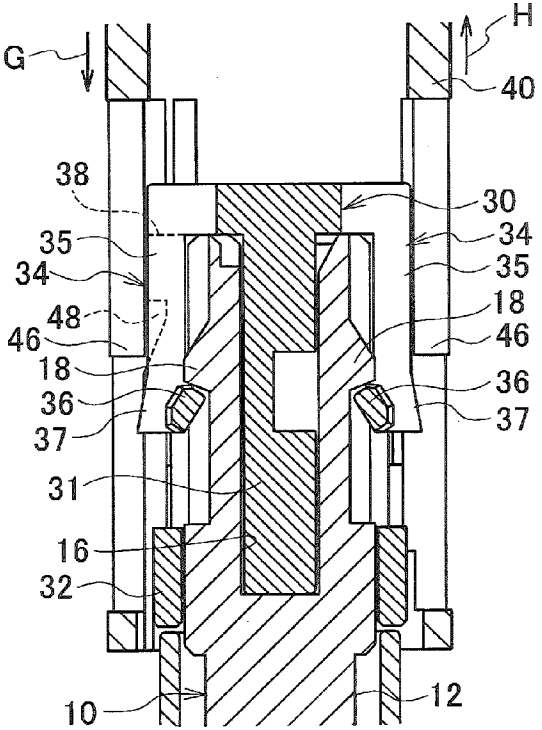
FIG. 13B illustrates a cross-sectional view cut along line E-E of FIG. 10 in the same operation step of the fitting operation illustrated in FIG. 13A.
Figure 13A:
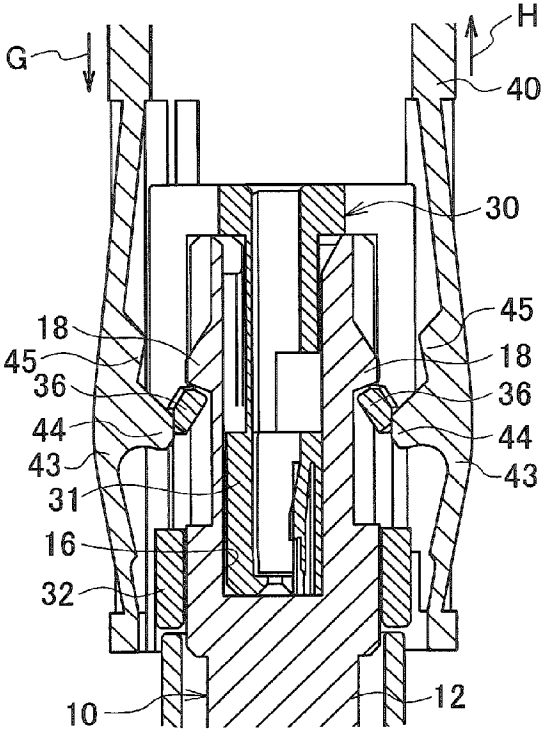
FIG. 13A illustrates a cross-sectional view cut along line D-D of FIG. 10.
Figure 14C:
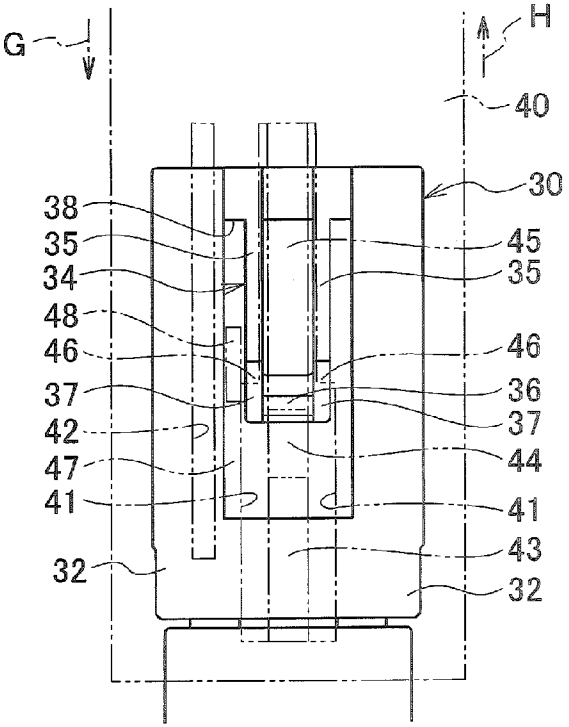
FIG. 14C illustrates an external view illustrating a position relationship between housings in the same operation step of the fitting operation illustrated in FIG. 14A.
Figure 14B:
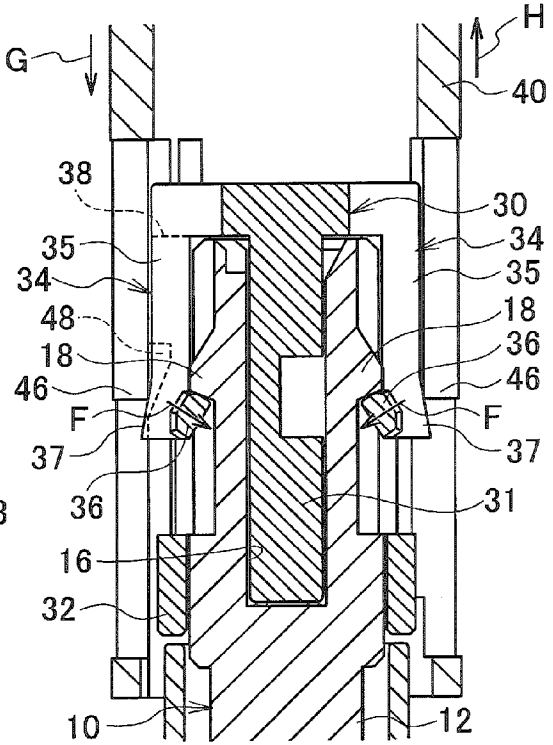
FIG. 14B illustrates a cross-sectional view cut along line E-E of FIG. 10 in the same operation step of the fitting operation illustrated in FIG. 14A.
Figure 14A:
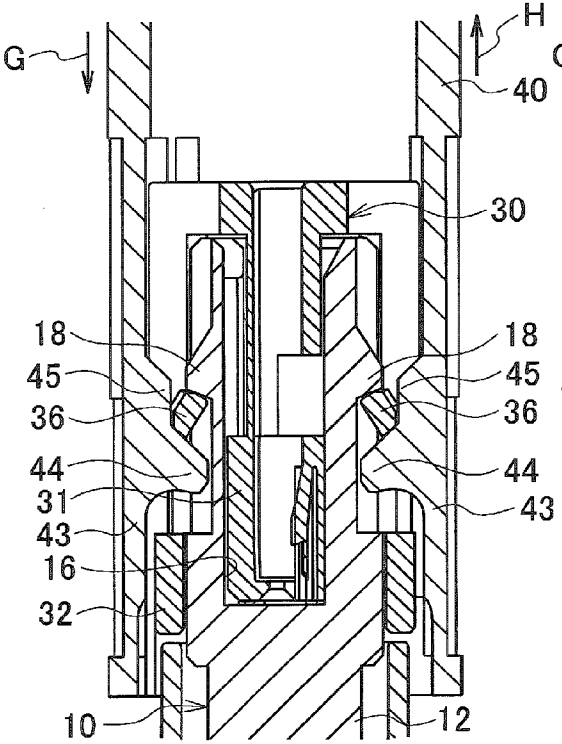
FIG. 14A illustrates a cross-sectional view cut along line D-D of FIG. 10.

The sheath lock part 44 of the sheath housing 40 can climb over the lock beak part 36 of the inner housing 30. When the sheath housing 40 is further pressed in the connector fitting direction G from this state, only the sheath housing 40 moves, as illustrated in FIGS. 13A to 13C. The sheath lock part 44 of the sheath housing 40 comes to completely climb over the lock beak part 36 of the inner housing 30 to recover the flexible deformation of the sheath lock part 44 and lock the sheath lock part 44 with the first lock part 18 of the first housing 12, as illustrated in FIGS. 14A to 14C. The sheath housing 40 has come to the sheath fitted position.

In the process from the fitting completed position to the sheath mounting position, the pressing part 46 of the sheath housing 40 slides on and presses the tapered part 37 of the inner housing 30. Pressing force F of the pressing part 46 acts on the tapered part 37, and its component force acts as the fitting force between the first housing 12 and the inner housing 30. This leads to an increase of the fitting force. The tapered part 37 is provided at the tip end of the flexible arm part 35 of the lock arm 34, while the inner surface of the lock beak part 36 abuts on the outer periphery surface of the first housing 12. The pressing force F thus acts effectively on the inner housing 30.

Finally, the sheath housing 40 is fixed on the cylinder head cover 3 for completion.

Figure 15:
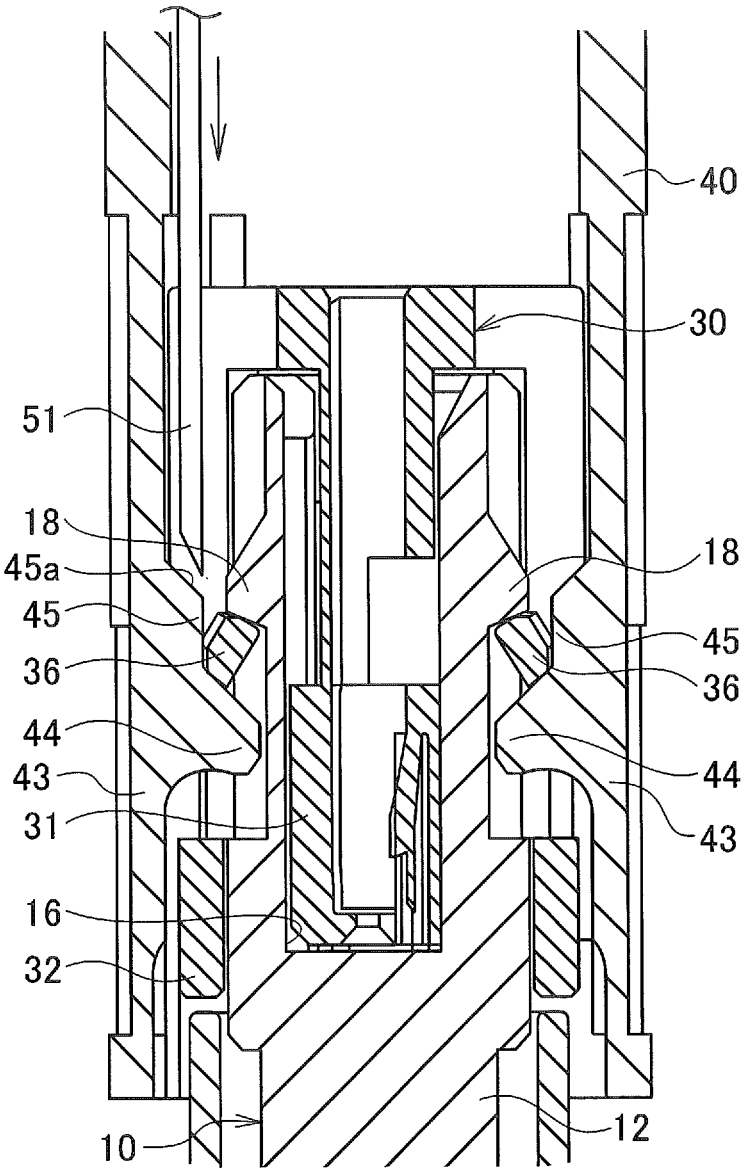
FIG. 15 is a cross-sectional view illustrating a releasing process of the sheath lock part with a releasing jig according to the embodiment of the present invention.
Figure 16B:
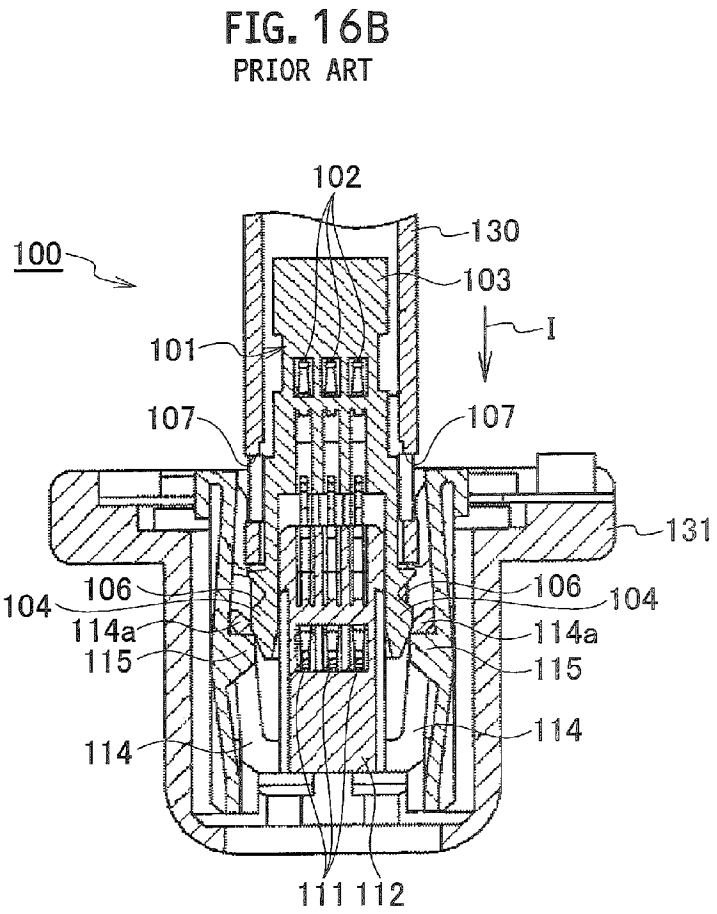
FIG. 16B PRIOR ART
FIG. 16B illustrates a fitting operation process of a prior art example.
Figure 16A:
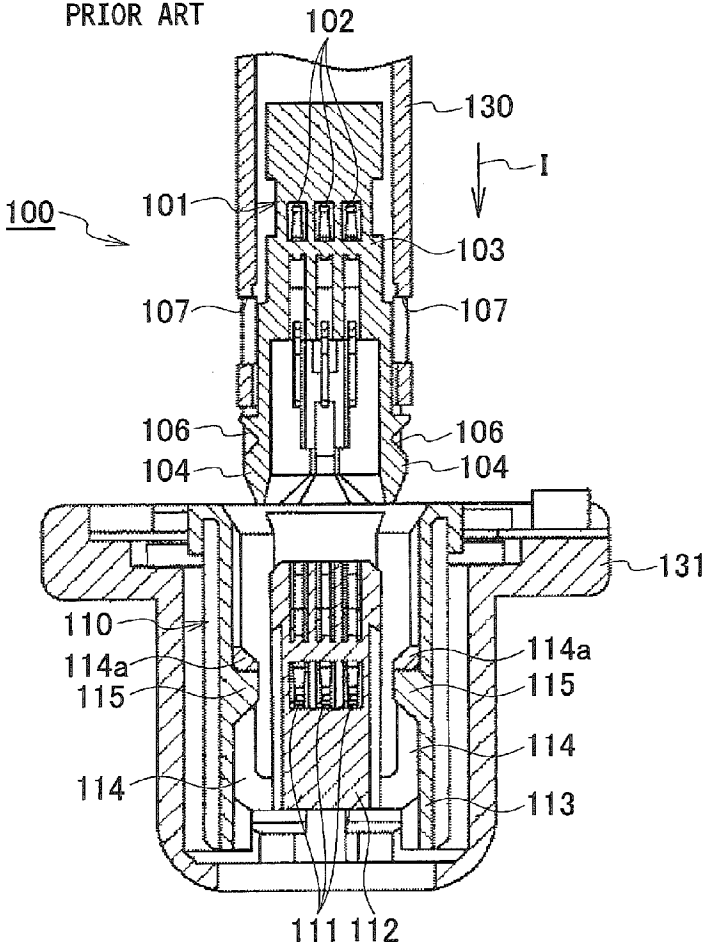
FIG. 16A PRIOR ART
FIG. 16A illustrates a fitting operation process of a prior art example.
Figure 17B:
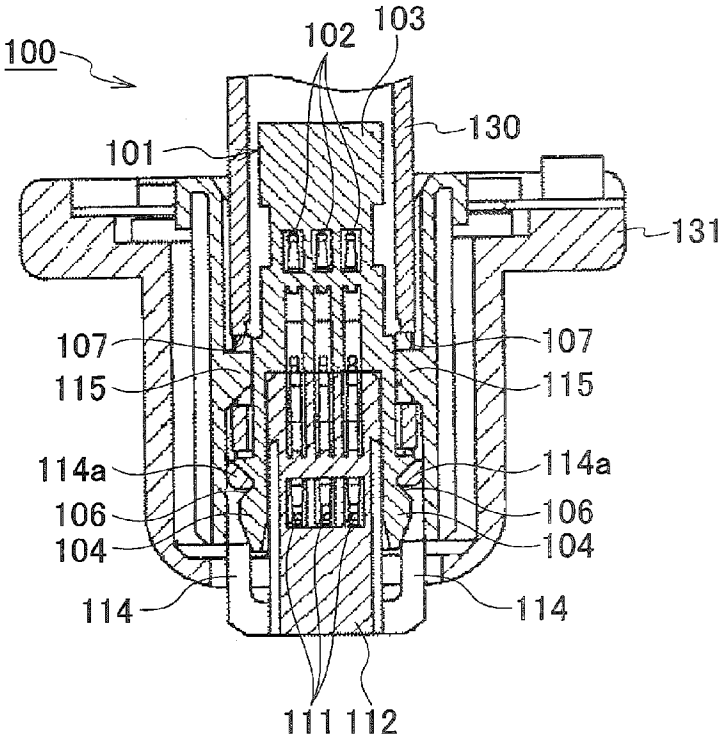
FIG. 17B PRIOR ART
FIG. 17B illustrates the fitting operation process of the prior art example.
Figure 17A:
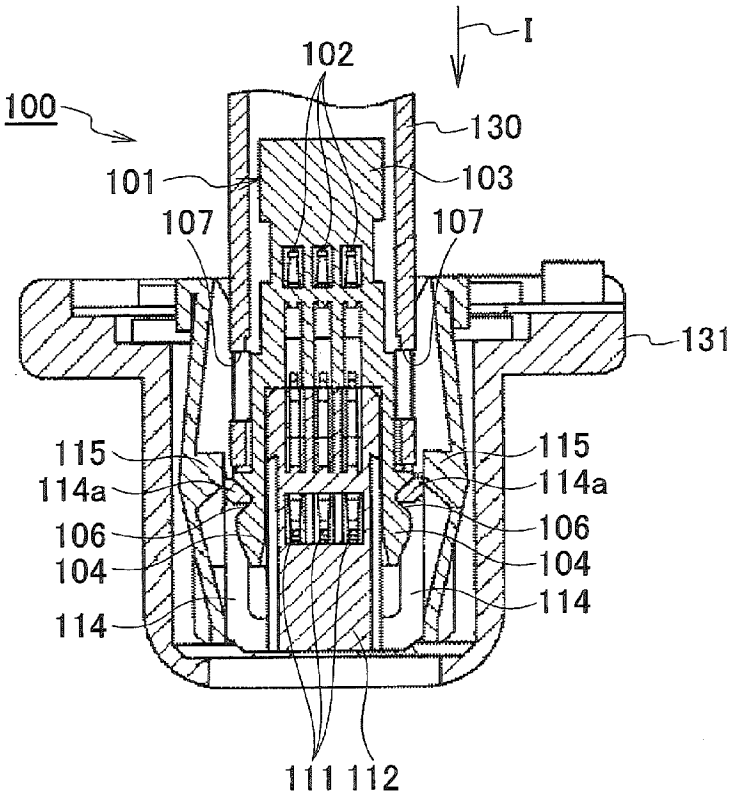
FIG. 17A PRIOR ART
FIG. 17A illustrates the fitting operation process of the prior art example.

Next, the fitted female connector part 20 is released from the male connector part 10 as described below. The releasing jig 51 is inserted into the sheath housing 40 from above to press the releasing projecting part 45 of the sheath lock part 44, as illustrated in FIG. 15. The first flexible arm part 43 then flexibly deforms outward to move the sheath lock part 44 to a lock releasing position. With this state being held, the sheath housing 40 is pulled out. As a result of this, only the sheath housing 40 moves in a pulling direction H, allowing the sheath lock part 44 to move to a position where the lock beak part 36 and the first lock part 18 are climbed over. The retaining projection 48 thus abuts on the stopper end face 38 of the inner housing 30. When the sheath housing 40 is further pulled from this position, the inner housing 30 is also pulled out to gradually release the inner housing 30 from the first housing 12 until the two parts are finally separated completely. Release of the female connector part 20 from the male connector part 10 is thus completed. The positional relationship between the sheath housing 40 and the inner housing 30 of the female connector part 20 returns to the initial positional relationship (see FIGS. 11A to 11C).

The connector 1 of the present embodiment described above includes the male connector part 10, which includes the first housing 12 for holding the male terminals 11, and the female connector part 20, which includes the inner housing 30 for holding the female terminals 21 and the sheath housing 40 accommodated in the inner housing 30 and movable in an axial direction of the inner housing 30. The first housing 12 includes the first lock part 18, while the inner housing 30 includes the lock beak part 36 of the lock arm 34 capable of locking with the first lock part 18. The sheath housing 40 includes the sheath lock part 44 that prevents movement relative to the inner housing 30 until the lock beak part 36 of the lock arm 34 locks with the first lock part 18, while allowing the movement with the inner housing 30 when the lock beak part 36 of the lock arm 34 has locked with the first lock part 18. When the female connector part 20 is moved in the connector fitting direction G relative to the male connector part 10, the first lock part 18 locks with the lock beak part 36 of the lock arm 34 at the fitting completed position between the first housing 12 and the inner housing 30. The sheath housing 40 then moves to the sheath fitted position relative to the inner housing 30 in the connector 1. The inner housing 30 and the sheath housing 40 include the pressing unit 50 that, when in the sheath fitted position, urges the inner housing 30 in the fitting direction with the first housing 12.

The female connector part 20 is formed of two members including the inner housing 30 to be fitted in the first housing 12 and the separately formed sheath housing 40. Thus, the female connector part 20 side fitted in the male connector part 10 has a smaller mass compared to the case in which the female connector part 20 is formed of one member. This improves the anti-vibration characteristic. Specifically, the anti-vibration characteristic improves compared to the case in which the female connector part 20 is formed of one member, because only the inner housing 30, instead of the entire female connector part 20, vibrates by the vibration of the male connector part 10, when the male connector part 10 vibrates by the vibration of the mounting part. In addition to the improved anti-vibration characteristic, the pressing unit 50 reinforces the fitting force between the first housing 12 and the inner housing 30. The first housing 12 and the inner housing 30 thus unitarily vibrate to effectively prevent individual vibrations. The contact reliability between terminals improves, because the sliding between the first terminals 11 and the second terminals 21 caused by separate and individual vibrations of the housings 12, 30, can be prevented.

The sheath housing 40 of the present embodiment is fixed to the cylinder head cover 3 at the mounting part, but may also be fixed to the male connector part 10. In other words, the sheath housing 40 may be fixed to other parts than the female connector part 20.

The outward deformation of the lock beak part 36 is prevented by the releasing projecting part 45 of the sheath housing 40 at the fitting completed position of the sheath housing 40. This leads to secure prevention of unlocking between the first lock part 18 of the male connector part 10 and the lock beak part 36 of the lock arm 34 of the female connector part 20.

The sheath lock part 44 is formed to be elastically deformable in a direction to climb over the first lock part 18 and the lock beak part 36 of the lock arm 34. The first lock part 18 is formed to allow the sheath lock part 44 to climb over the first lock part 18. The lock beak part 36 of the lock arm 34 is, when unlocked with the first lock part 18, formed not to climb over the sheath lock part 44. When locked with the first lock part 18, the lock beak part 36 of the lock arm 34 is formed to allow the sheath lock part 44 to climb over the lock beak part 36. In the connector fitting process, the movement relative to the inner housing 30 is prevented until the lock beak part 36 of the lock arm 34 locks the first lock part 18, because the sheath lock part 44 cannot climb over the lock beak part 36 of the lock arm 34. When the lock beak part 36 of the lock arm 34 locks with the first lock part 18, the sheath lock part 44 climbs over the first lock part 18 and the lock beak part 36 of the lock arm 34 to allow the movement relative to the inner housing 30. In fitting the connector, therefore, the sheath housing 40 is gripped and moved in the connector fitting direction G to allow the inner housing 30 to move to the fitting completed position where the inner housing 30 is fitted with the first housing 12. Following this movement, the sheath housing 40 is moved to the sheath fitting position of the inner housing 30. Thus, the male connector part 10 and the female connector part 20 can be fitted with each other in one action. This leads to excellent workability in fitting. Workability is also excellent in releasing, as the male connector part 10 can be released from the female connector part 20 in one action.

The pressing unit 50 includes the tapered part 37, which is provided on the inner housing 30 and projects outward relative to the connector fitting direction G, and the pressing part 46, which is provided on the sheath housing 40 and presses the tapered part 37 at the sheath fitting position of the sheath housing 40. Thus, the fitting force between the first housing 12 and the inner housing 30 can increase by a simple structure. The pressing unit 50 may include the pressing part formed on the inner housing 30 side, and the tapered part formed on the sheath housing 40 side. The pressing unit 50 may also include the tapered part both on the inner housing 30 side and the sheath housing 40 side.

The first housing 12 includes the backlash reduction ribs 17 formed on the side wall of the housing fitting chamber 16 to press the side surface of the inner housing 30, such that the backlashes occurring in a direction perpendicular to the connector fitting direction G are eliminated. This leads to an improved anti-vibration characteristic and an improved contact reliability among terminals.

The sheath housing 40 includes the releasing projecting part 45 which allows the sheath lock part 44 to move to the lock releasing position without pressing the sheath lock part 44 by the releasing jig 51. Any damage to the sheath lock part 44 caused by the releasing jig 51 is prevented. The releasing projecting part 45 is formed continuously from the sheath lock part 44, such that the sheath lock part 44 can move to the lock releasing position with only a small external force. Further, the releasing projecting part 45 has the tapered face 45*a* formed on the side to which the releasing jig 51 is inserted, allowing the sheath lock part 44 to move in the lock releasing direction by moving the releasing jig 51 in the inserting direction.

Although the embodiment of the present invention has been described heretofore, the embodiment is merely exemplified for facilitating the understanding of the present invention, and the present invention is not limited to the embodiment. The technical scope of the present invention may include not only the specific technical matters disclosed in the above-described embodiment but also various modifications, changes, and alternative techniques easily derived from the above-described specific technical matters.

What is claimed is:

1. A connector comprising:

a first connector part fixed on a connector mounting part and including a first housing for holding a first terminal; and a second connector part including an inner housing for holding a second terminal and a sheath housing accommodating the inner housing and movable to the inner housing, wherein the first housing is provided with a first lock part, the inner housing is provided with a second lock part capable of locking with the first lock part, the sheath housing is provided with a sheath lock part that prevents movement relative to the inner housing until the second lock part locks with the first lock part, and allows the movement with the inner housing when the second lock part is locked with the first lock part, wherein the first lock part is locked with the second lock part at a fitting completed position between the first housing and the inner housing when the second connector part is moved relative to the first connector part in a connector fitting direction, and the sheath housing is subsequently moved to a sheath fitted position relative to the inner housing, wherein the inner housing and the sheath housing include pressing unit that urges the inner housing in a fitting direction with the first housing at the sheath fitted position.

2. The connector according to claim 1, wherein the sheath lock part is formed to be elastically deformable in a direction to climb over the first lock part and the second lock part, the first lock part is formed to allow the sheath lock part to climb over the first lock part, the second lock part is formed to prevent the sheath lock part from climbing over the second lock part before the second lock part locks with the first lock part, and is formed to allow the sheath lock part to climb over the second lock part when the second lock part is locked with the first lock part, and the sheath lock part is not able to climb over the second lock part until the second lock part locks with the first lock part in a connector fitting step, such that a movement relative to the inner housing is prevented, and the sheath lock part climbs over the first lock part and the second lock part to allow the sheath housing to move relative to the inner housing when the second lock part is locked with the first lock part.

3. The connector according to claim 1, wherein the pressing unit is a pressing part including a tapered part provided on the inner housing and inclined relative to the connector fitting direction, and a pressing part provided on the sheath housing to press the tapered part at the sheath fitted position.

4. The connector according to claim 1, wherein the first housing includes a plurality of backlash reduction ribs formed on a side wall of a housing fitting chamber of the first housing to press a side surface of the inner housing.

* * * * *